US006682162B2

(12) United States Patent
Simons et al.

(10) Patent No.: US 6,682,162 B2
(45) Date of Patent: Jan. 27, 2004

(54) PRINTING APPARATUS WITH MEASURING CIRCUIT FOR DIAGNOSIS OF CONDITION OF EACH ELECTROMECHANICAL TRANSDUCER

(75) Inventors: Johannes Mathieu Marie Simons, Venlo (NL); Mark Alexander Groninger, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 10/020,915

(22) Filed: Dec. 19, 2001

(65) Prior Publication Data

US 2002/0089562 A1 Jul. 11, 2002

Related U.S. Application Data

(63) Continuation of application No. 09/458,708, filed on Dec. 13, 1999.

(30) Foreign Application Priority Data

Dec. 14, 1998 (NL) ..... 1010798

(51) Int. Cl.[7] ..... B41J 29/393
(52) U.S. Cl. ..... 347/19; 347/92
(58) Field of Search ..... 347/14, 19, 68, 347/92, 23

(56) References Cited

U.S. PATENT DOCUMENTS

| | | | | |
|---|---|---|---|---|
| 4,471,363 A | | 9/1984 | Hanaoka | 347/10 |
| 4,498,088 A | | 2/1985 | Kanayama | 347/92 |
| 4,590,482 A | * | 5/1986 | Hay et al. | 347/19 |
| 4,625,220 A | | 11/1986 | Nagashima | 347/14 |
| 4,695,852 A | | 9/1987 | Scardovi | 347/14 |
| 5,072,235 A | | 12/1991 | Slowik et al. | 347/19 |
| 5,500,657 A | | 3/1996 | Yauchi et al. | 347/9 |
| 6,076,914 A | | 6/2000 | Imai | 347/19 |

FOREIGN PATENT DOCUMENTS

| | | |
|---|---|---|
| DE | 3319353 | 11/1984 |
| DE | 3924948 | 1/1991 |
| EP | 0816931 | 1/1998 |
| JP | 03146346 | 6/1991 |

* cited by examiner

*Primary Examiner*—Stephen D. Meier
*Assistant Examiner*—Blaise Mouttet
(74) *Attorney, Agent, or Firm*—Birch, Stewart, Kolasch & Birch, LLP

(57) ABSTRACT

A printing apparatus including at least one ink duct provided with an electromechanical transducer, a driver circuit provided with a pulse generator and operatively associated with the transducer to energize the transducer, a measuring circuit operatively associated with the transducer for measuring an electrical signal generated by the transducer in response to energizing by the pulse generator, a device for breaking the circuits in such a manner so that when the drive circuit is open, the measuring circuit is closed, wherein measurement of the electrical signal takes place when the printing apparatus is in a printing mode.

10 Claims, 4 Drawing Sheets

PRINTING APPARATUS WITH MEASURING CIRCUIT FOR DIAGNOSIS OF CONDITION OF EACH ELECTROMECHANICAL TRANSDUCER

This application is a continuation of co-pending Application No. 09/458,708, filed on Dec. 13, 1999, the entire contents of which are hereby incorporated by reference and for which priority is claimed under 35 U.S.C. §120; and this application claims priority of Application No. 1010798 filed in The Netherlands on Dec. 14, 1998 under 35 U.S.C. §119.

BACKGROUND OF THE INVENTION

1. Field of the Invention

The present invention relates to a printing apparatus adapted to eject ink droplets from ink ducts, comprising at least one ink duct provided with an electromechanical transducer, a drive circuit provided with a pulse generator to energize the transducer, a measuring circuit for measuring an electrical signal generated by the transducer in response to the energization, and means to break the circuits in such manner that the drive circuit is open if the measuring circuit is closed.

2. Background Art

A printing apparatus of this kind is known from U.S. Pat. No. 4,498,088. In this printing apparatus, which is of the "drop-on-demand" type, the drive circuit applies an electrical pulse across the electromechanical transducer, more particularly a piezo element, so that the transducer is energized and generates a pressure wave in the ink duct. An ink droplet is ejected from the ink duct as a result. To guarantee reliability of such a printing apparatus, means are provided to detect breakdown of the ink duct, e.g. due to the presence of an air bubble in said duct. These means form part of a measuring system and comprise a measuring circuit with which it is possible to measure the resulting vibration in the ink duct after a pressure wave has been generated by the transducer. For this purpose, the transducer is used as a sensor: Thus, a vibration in the duct in turn results in the deformation of the electromechanical transducer, so that it generates an electrical signal. If air bubbles are present in the duct, this results in another vibration and consequently another electrical signal. A breakdown of an ink duct can thus be readily detected by measuring the electrical signal. A repair operation for the duct in question can then be carried out. One important disadvantage of a printing apparatus of this kind is that in order to check the condition of the ink ducts, the printing apparatus must leave the normal printing mode, i.e. the mode in which at least one ink duct ejects ink droplets for generating an image on a substrate, to pass to a measuring mode. In the measuring mode the transducer is energized so that the ink duct is vibrated but it is not possible to achieve ejection of an ink droplet from that duct. The resulting electrical signal is measured, and after this it is possible to determine whether there are any air bubbles in the ink duct. After the ink duct has been checked, the printing apparatus is returned to the printing mode, possibly after a repair operation has been carried out. The need to switch between a printing mode and a measuring mode results in a loss of productivity of the printing apparatus. Productivity will further fall with increasing reliability requirements for the printing apparatus, which means that the interval of time between the measuring modes has to be reduced. In addition to loss of productivity, the known printing apparatus has the disadvantage that two drive circuits provided with pulse generators are required for the transducer: one drive circuit to energize the transducer when the printing apparatus is in a printing mode, and a drive circuit to energize the transducer when it is in a measuring mode. This not only makes the printing apparatus expensive, but also, due to the increase in the number of components, less reliable.

SUMMARY OF THE INVENTION

The object of the present invention is to obviate the above-identified disadvantages. To this end, a printing apparatus has been invented wherein measurement of the electrical signal generated by the transducer in response to energization takes place when the printing apparatus is in a printing mode. There is therefore no need to interrupt the printing mode. The electrical signal is measured immediately after the transducer has been energized, the energization being such that an ink droplet is ejected with the duct operating as normal, in order to generate an image on a substrate. As a result there is no loss of productivity and in addition only one drive circuit is required for the transducer. An additional advantage is that the breakdown of the ink duct can be detected practically immediately, so that in many cases a repair operation can be carried out before any visible artefacts have appeared in an image. This means that a printing apparatus according to the present invention has a very high reliability. In one preferred embodiment the drive circuit and the measuring circuit are connected to the transducer via a common line serving as an input and output for electrical signals. This has advantages when the printhead is provided with a large number of ink ducts. The circuit can further be simplified by breaking the circuits by means of a changeover switch, so that the drive circuit is automatically opened as soon as the measuring circuit is closed. This changeover switch can be embodied by known electrical means but can also be integrated in the drive IC.

To check whether a vibration in the duct differs from a normal vibration, i.e. from a vibration when the duct is operating properly, the electrical signal generated by the transducer in response to energization can be compared with the electrical signal generated by a dummy element having the same impedance as the transducer in response to a comparable energization. Since, however, it is difficult to find a dummy element having in all circumstances exactly the same impedance as the transducer, it is preferable not to compare the electrical signal with a signal generated by a dummy element, but to characterize the electrical signal itself. For this purpose, at least one wave characteristic selected, for example, from the group comprising: amplitude, zero-axis crossing, frequency, phase and damping should be determined. It has been surprisingly discovered that in this way deviation in an ink duct can be detected with much higher accuracy. In this way it is possible to determine unambiguously what is the cause of malfunctioning of the ink duct (whether an air bubble, a solid particle clogging the duct, or a mechanical fault in the piezo element and so on) so that a repair operation can be accurately adapted to such cause.

In addition, a small deviation can be found which at that time is not yet affecting the ejection of ink droplets, for example an air bubble which is too small or still too far away from the opening of the ink duct to prevent ejection of an ink droplet. This enables preventive repair of an ink duct, so that generally there should be no artefacts appearing in an image. This is a considerable contribution to the reliability of the printing apparatus. In one preferred embodiment, a measured wave characteristic is compared with a reference value so that it is possible to determine easily whether a repair operation is required. In order further to increase the sensitivity of the measuring circuit, it can be provided with an amplifier. If an input of the amplifier is connected to the printing apparatus earth, stray capacitances (e.g. in the wiring) and leakage currents will also have hardly any effect on the measurement of the electrical signal generated by the transducer, so that the measurement accuracy further increases. In view of the simplicity of the measuring circuit in the printing apparatus according to the present invention, it is possible to provide a separate measuring circuit for all the transducers in the printing apparatus, even if there are several hundred. This makes it possible to check each duct, after an ink droplet has been ejected, for correct operation thereof, so that maximum reliability can be guaranteed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
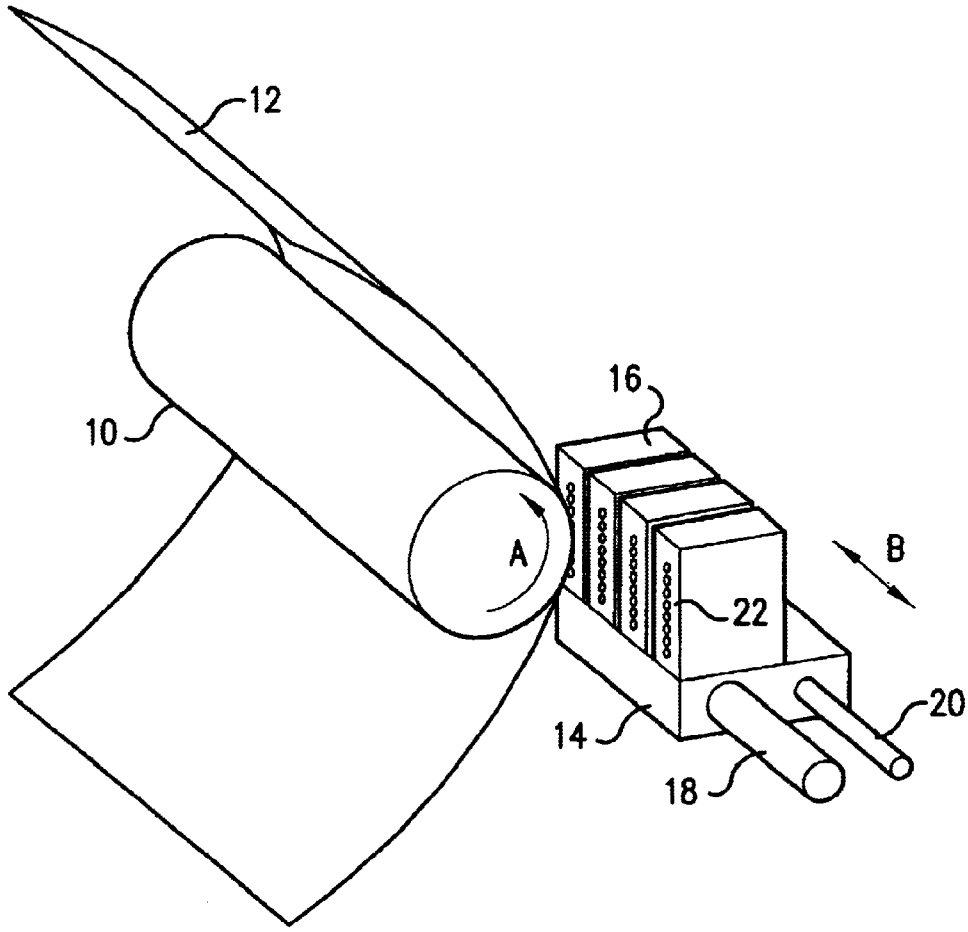
FIG. 1 is a diagram of the main components of a printing apparatus provided with ink ducts.

FIG. 1 shows a printing apparatus provided with ink ducts. In this embodiment, the printing apparatus comprises a roller 10 to support a receiving medium 12 and guide it along the four printing heads 16. The roller 10 is rotatable about its axis as indicated by the arrow A. A carriage 14 carries the four print-heads 16, one for each of the colors cyan, magenta, yellow and black, and can be moved in reciprocation in the direction indicated by the double arrow B, parallel to the roller 10. In this way the print-heads 16 can scan the receiving medium 12. The carriage 14 is guided on rods 18 and 20 and is driven by suitable means (not shown). In the embodiment as illustrated in the drawing, each print-head 16 comprises eight ink ducts, each with its own outflow aperture 22, said ducts forming an imaginary line perpendicular to the axis of the roller 10. In one practical embodiment of a printing apparatus, the number of ink ducts for each print-head 16 will be many times greater. Each ink duct is provided with an electromechanical transducer (not shown) and associated drive circuit. In this way, the ink duct, transducer and drive circuit form a unit which can serve to eject ink droplets in the direction of the roller 10. If the transducers are energized image-wise, then an image forms, built up from ink droplets, on the receiving medium 12.

Figure 2:
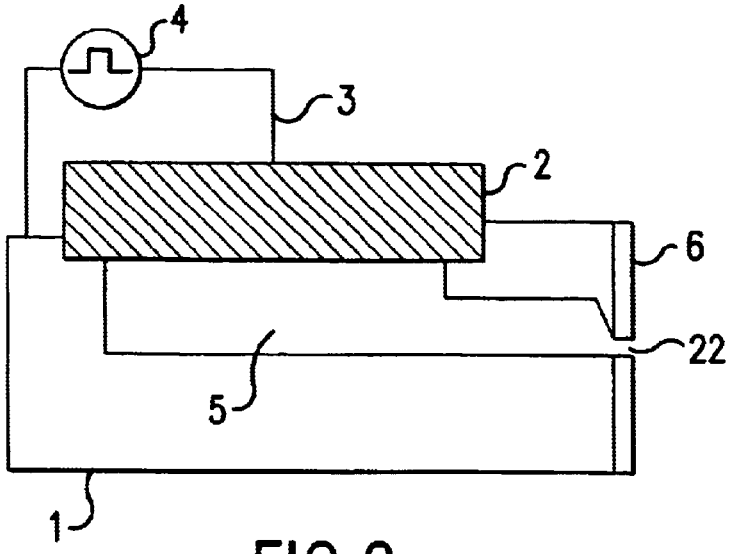
FIG. 2 is a diagram of an ink duct provided with an electromechanical transducer.

In FIG. 2, an ink duct 5 is provided with an electromechanical transducer 2, in this example a piezo element. Ink duct 5 is formed by a groove in base plate 1 and is defined at the top mainly by piezo element 2. At the end the ink duct 5 merges into an outflow aperture 22 formed by a nozzle plate 6. When a pulse is applied across piezo element 2 by pulse generator 4 via the drive circuit 3, said element generates a pressure wave in ink duct 5 so that an ink droplet is ejected from the outflow opening 22.

Figure 3:
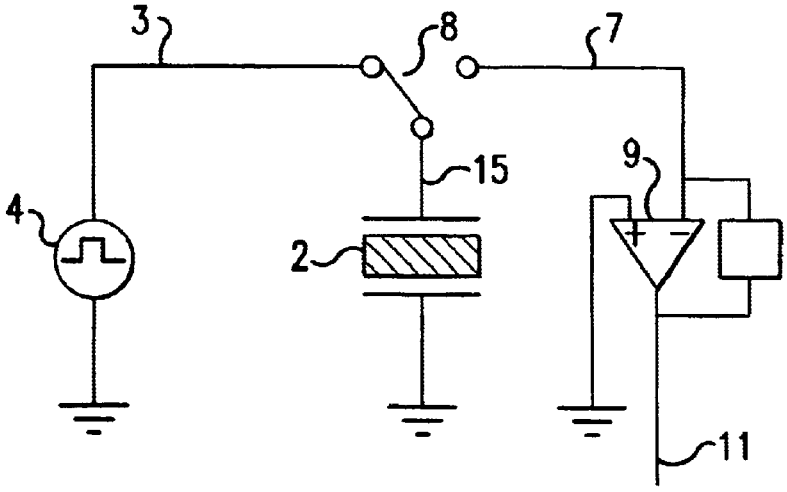
FIG. 3 is a block schematic of the electromechanical transducer, the drive circuit and the measuring circuit in a preferred embodiment.

FIG. 3 is a block schematic diagram of the electromechanical transducer 2, the drive circuit 3 and the measuring circuit 7 in a preferred embodiment. Drive circuit 3 provided with pulse generator 4, and measuring circuit 7 provided with amplifier 9, are connected to piezo element 2 via a common line 15. The circuits are opened and closed by changeover switch 8. After a pulse has been applied across the piezo element 2 by the pulse generator 4, element 2 in turn experiences a resulting vibration in the ink duct, and this is converted to an electrical signal by element 2. If, after termination of the pulse, changeover switch 8 is switched so as to close the measuring circuit, the said electrical signal is discharged through the measuring circuit 7. Amplifier 9 amplifies this signal which is fed via output 11 to an interpretation circuit (not shown), which if required may be followed by an action circuit (not shown).

Figure 4:
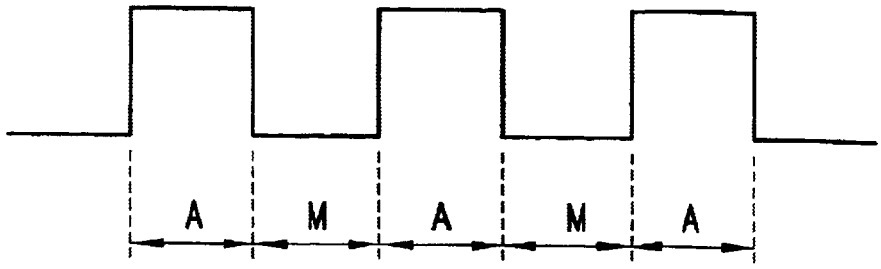
FIG. 4 is a diagram showing how the circuits can be switched.

FIG. 4 shows how the circuits 3 and 7 could be switched. During a drive period A the drive circuit 3 is closed so that piezo element 2 can be energized. After energization has taken place, a measuring period M starts, in which measuring circuit 7 is closed via changeover switch 8 and drive circuit 7 is opened. After expiration of measuring period M, in which the electrical signal generated by piezo element 2 is measured, the drive circuit is closed and a new drive period A starts. Of course there are many variants of this switching procedure. For example, a measuring period M could also follow after the piezo element has been energized a number of times in a drive period. In an embodiment in which very high reliability is required, each duct could be checked after each pulse. If a repair operation is necessary, it can be restricted to the duct in which the malfunctions occur. Of course, it is possible to check the functioning of an ink duct during the repair operation as well and to stop this operation as soon as the duct operates properly again. If reliability is less important, it could be decided, for example, to check one jetting duct for each jet pulse. It would also be possible to check a duct after a fixed number of ejected ink droplets or after a specific interval of time.

Figure 5:
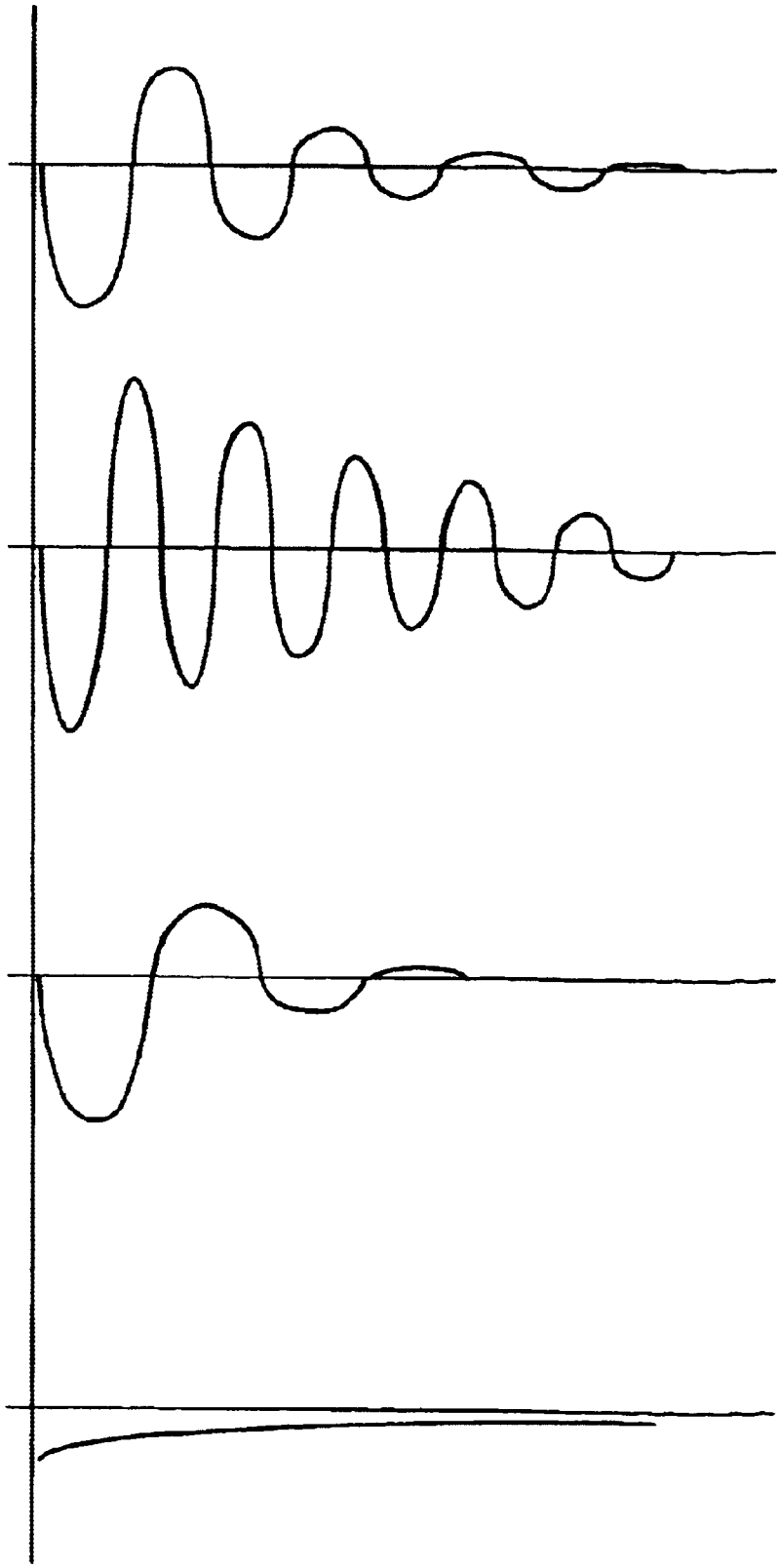
FIG. 5 shows a number of electrical signals generated by a transducer according to the condition of the ink duct.

FIG. 5 shows a number of electrical signals as generated by a transducer in response to a pressure wave in an ink duct, dependent on the state of said ink duct. If an ink duct is operating properly, the result is a damped sinusoidal electrical signal as shown by Curve 1. For a given ink duct geometry, the presence of an air bubble results in an electrical signal as shown in Curve 2. This signal has a higher frequency, higher initial amplitude and weaker damping. If a duct is (partially) closed by a solid particle, then for the same duct geometry this results in an electrical signal having a lower frequency, smaller initial amplitude and stronger damping as shown in Curve 3. Finally, Curve 4 is an example of an electrical signal measured in the case of a specific mechanical deviation of the piezo element.

It will be apparent from the foregoing that the cause of the malfunctioning of an ink duct (or the expected malfunctioning) can be accurately determined in a printing apparatus according to the present invention so that it is possible to adapt the repair operation to such cause.

The measurement can be used, for example, to check the operation of the individual ducts after production of a print-head provided with one or more such ducts. If errors have occurred in production, e.g. a layer of glue that has worked loose, a scratch in a wall of a duct, a faulty piezo element etc., these faults are recognized and can be repaired if possible.

In the case of a printing apparatus in use, the measurement can be used to check the state of the ink ducts (continuously) without any loss of productivity. The high accuracy with which irregularities in an ink duct can be detected even makes it possible to carry out preventive repairs on ducts, i.e. before there is any question of failure of an ink duct.

In a preferred embodiment of the printing apparatus, one or more wave characteristics of the electrical signal as shown in FIG. 5 are compared with a set of reference values which in a practical embodiment are provided with top and bottom limits within which a wave characteristic of a normally operating duct should be located. The reference values can be determined in many ways, but this is not an essential part of the invention. For example, the reference values can be determined after completion of the production process of a print-head. In addition, the reference values could be determined when the printing apparatus is in operation, by taking the average over a large number of pulses. In this way it is possible to adapt these values continuously, so that, for example, (slow) wear processes in the print-head have no adverse influence on the measurement. It is also possible to compare the wave characteristics of an individual duct with those of one or more (neighboring) ducts.

The invention is not limited to the embodiments described. Modifications can easily be made by one skilled in the art. For example, the required reliability in relation to the productivity of the printing apparatus depends, inter alia, on the way in which the reference values are determined, and whether this is carried out for each individual duct or for all the ducts together, how far apart the top and bottom limits of the reference value are situated, how many wave characteristics are determined to establish the condition of a duct, and so on.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing apparatus comprising:

at least one ink duct provided with an electromechanical transducer, a drive circuit provided with a pulse generator and operatively associated with the transducer to energize said transducer by providing an electrical pulse, a measuring circuit operatively associated with the transducer for measuring and characterizing an electrical signal generated directly by the transducer in response to said energizing by the pulse generator, means for breaking the circuits in such a manner so that when the drive circuit is open, the measuring circuit is closed in order to separate the electrical pulse from the electrical signal generated by the transducer, wherein measurement and characterization of the electrical signal takes place when the printing apparatus is in a printing mode such that in this printing mode, a deviation in the ink duct other than for an air bubble can be distinguished from the air bubble based on the characterization of the electrical signal.

2. The printing apparatus according to claim 1, wherein the drive circuit and the measuring circuit are connected to the transducer via a common line.

3. The printing apparatus according to claim 2, wherein the means for breaking the circuits comprises a changeover switch.

4. The printing apparatus according to claim 1, wherein at least one wave characteristic is determined from the electrical signal generated by the transducer.

5. The printing apparatus according to claim 4, wherein the wave characteristic is selected from the group consisting of amplitude, zero-axis crossing, frequency, phase and damping.

6. The printing apparatus according to claim 4, wherein the wave characteristic is compared with a reference value.

7. The printing apparatus according to claim 1, wherein the measuring circuit is provided with an amplifier.

8. The printing apparatus according to claim 7, wherein one input of the amplifier is connected to the printing apparatus earth.

9. The printing apparatus according to claim 1, wherein said electrical signal is measured after each energization of the transducer.

10. A printing method for a printing apparatus which comprises:

providing at least one ink duct with an electromechanical transducer, energizing the transducer with a drive circuit provided with a pulse generator which provides an electrical pulse, measuring an electrical signal with a measuring circuit and characterizing the electrical signal generated directly by the transducer in response to said energizing by the pulse generator, and breaking the circuits in such a manner so that when the drive circuit is open, the measuring circuit is closed in order to separate the electrical pulse from the electrical signal generated by the transducer, wherein the measurement and characterization of the electrical signal takes place when the printing apparatus is in a printing mode such that in this printing mode, a deviation in the ink duct other than for an air bubble can be distinguished from the air bubble based on the characterization of the electrical signal.

* * * * *